US005966767A

United States Patent [19]

Lu et al.

[11] Patent Number: 5,966,767

[45] Date of Patent: Oct. 19, 1999

[54] PIPE CLEANING DEVICE

[75] Inventors: Chung-Chien Lu, Hsinchu; Tien-Fu Tseng, Hsien; Chih-Horng Chou; Andy Jeng, both of Hsinchu, all of Taiwan

[73] Assignee: United Microelectronics Corp., Hsinchu, Taiwan

[21] Appl. No.: 09/087,062

[22] Filed: May 29, 1998

[30] Foreign Application Priority Data

Mar. 30, 1998 [TW] Taiwan ..... 87104753

[51] Int. Cl.[6] ..... B08B 9/00; B08B 9/02; B08B 9/087

[52] U.S. Cl. ..... 15/104.05; 15/104.16

[58] Field of Search ..... 15/104.068, 104.09, 15/104.13, 104.05, 104.15, 104.16, 104.03, 104.095, 104.12; 401/9

[56] References Cited

U.S. PATENT DOCUMENTS

| | | |
|---|---|---|
| 49,327 | 8/1865 | Werner, Jr. . |
| 599,840 | 3/1898 | Holden . |
| 986,844 | 3/1911 | McCloskey . |
| 2,026,680 | 1/1936 | Jacobsen . |
| 2,148,754 | 2/1939 | Jacobsen . |
| 4,271,556 | 6/1981 | Farrell, Jr. . |
| 4,795,495 | 1/1989 | Dobson, Sr. . |

*Primary Examiner*—Terrence R. Till
*Assistant Examiner*—Jennifer C. McNeil
*Attorney, Agent, or Firm*—Knobbe, Martens, Olson & Bear, LLP

[57] ABSTRACT

A pipe cleaning device has a handle, a center rod, a center rod sealing plate, and a scraper assembly. The center rod has a central hollow space having one end connected to the handle and the scraper assembly mounted on the other end. The center rod sealing plate is a three-plate structure for sealing off the pipe opening. The center rod sealing plate has a central hole for the insertion of the center rod. The three-plate structure of the center rod sealing plate serves to increase the ease of disassembling and maintenance. The scraper assembly includes an upper scraper and a lower scraper, wherein the lower scraper has additional scraping knives on its blades to facilitate the scraping of blocking material inside the pipe. Moreover, the scrapers do not block off gas flow inside the pipe completely, so the pump can still pump exhaust gases out even when the scraper assembly is in use. The center rod also has a water inlet located next to the handle and a water outlet between the upper scraper and the lower scraper. Therefore, solvent or water can be pumped to assist the cleaning action.

9 Claims, 5 Drawing Sheets

PIPE CLEANING DEVICE

CROSS-REFERENCE TO RELATED APPLICATION

This application claims the priority benefit of Taiwan application serial no. 87104753, filed Mar. 30, 1998, the full disclosure of which is incorporated herein by reference.

BACKGROUND OF THE INVENTION

1. Field of Invention

The present invention relates to a pipe-cleaning device. More particularly, the present invention relates to a device for cleaning pump outlets.

2. Description of Related Art

FIG. 1 shows a conventional pipe cleaning assembly located next to a pump outlet. As shown in FIG. 1, the pump transports exhaust gases 100 into a pipe 102. The exhaust gases then leave pipe 102 and enter a wet scrubber water tank 104. As the exhaust gases flow through pipe 102, they deposit a layer of high molecular compound or unwanted material 106. Eventually, if the unwanted material 106 is allowed to accumulate long enough, the pipe 102 may be blocked. Therefore, it is necessary to schedule manual cleanings of pipe 102, at regular intervals, so that pipe blockage will not cause too much pressure to build up in the pipe 102. Such a buildup of excessive pressure can endanger operation or trip the machine. In general, the pipe 102 has an end cap 108 for preventing leakage of poisonous gases. To prevent chlorine or other by-products of semiconductor manufacturing from leaking out from the pipe 102 while the pipe 102 is cleaned, the machine has to be stopped. The dirt deposits on the sidewalls of the pipe 102 are normally removed by manually pushing a rod down the pipe. However, this cleaning method is unable to clean up the pipe thoroughly. Furthermore, it may be necessary to flush the blocking material with water as well.

In light of the foregoing, there is a need to provide a device that can be operated manually and is able to clean the pipe thoroughly without having to stop the machine.

SUMMARY OF THE INVENTION

Accordingly, the present invention provides a special scraper assembly having not only an increased scraping limit for blocking material lining a pipe, but also a "non-circular" design so that gases can bypass the blades of the scraper and permit the normal operation of the machine while the pipe is cleaned. In addition, the hollow tube-like center rod design allows passage of chemical solution or water into the center rod and then ejection out through an outlet between the scraper blades. When chemical solution or water is ejected from the center rod, a water flushing action is achieved. This invention also has a sealing plate capable of sealing off the outlet terminal of the pipe. Moreover, the special three-piece structure of sealing plate can be disassembled for routine maintenance.

To achieve these and other advantages and in accordance with the purpose of the invention, as embodied and broadly described herein, the invention provides a pipe cleaning device. The pipe-cleaning device comprises a handle, a center rod, a center rod sealing plate, and a scraper assembly. The center rod has a central hollow space having one end connected to the handle and scraper blades fixedly mounted on the other end. The center rod sealing plate is a three-plate structure for sealing off the pipe opening. The center rod sealing plate has a central hole for inserting the center rod.

The center rod is capable of moving freely within the central hole. The three-plate structure of the center rod sealing plate serves to increase the ease of disassembling and maintenance. The scraper assembly includes an upper scraper and a lower scraper, wherein the lower scraper has additional scraping knives on its blades to facilitate the scraping of blocking material inside the pipe. Moreover, the scrapers do not block gas flow inside the pipe completely, so the pump can still pump out exhaust gases. The center rod also has a water inlet located next to the handle and a water outlet between the upper scraper and the lower scraper. Therefore, solvent or water can be pumped in to clean the wall while the scrapers are operated manually.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
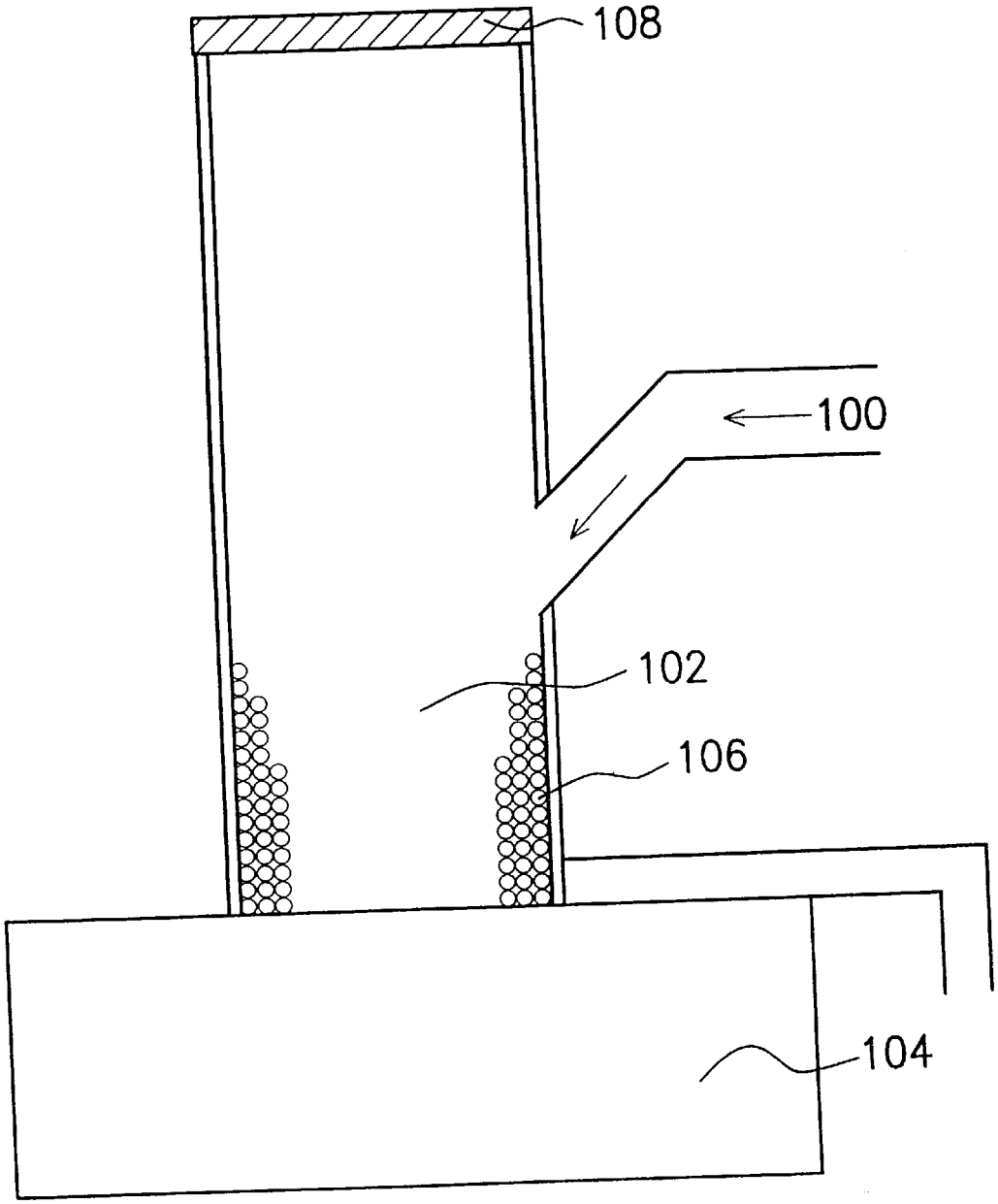
FIG. 1 (PRIOR ART)
FIG. 1 shows a conventional pipe cleaning assembly located next to a pump outlet.

Reference will now be made in detail to the present preferred embodiments of the invention, examples of which are illustrated in the accompanying drawings. Wherever possible, the same reference numbers are used in the drawings and the description to refer to the same or like parts.

Figure 2:
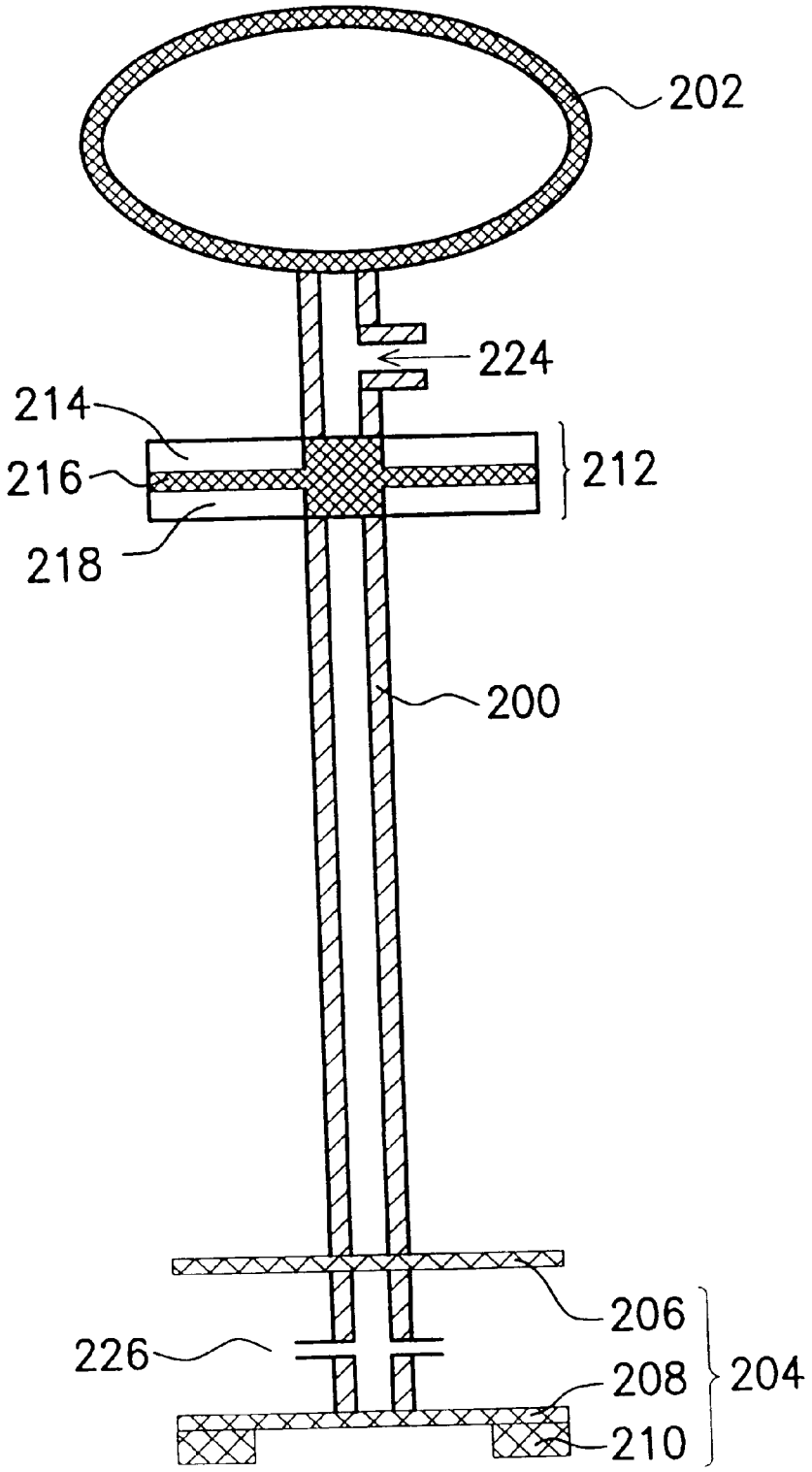
FIG. 2 shows an assembly of the pipe-cleaning device according to the preferred embodiment of this invention.

FIG. 2 shows an assembly of the pipe-cleaning device according to the preferred embodiment of this invention. As shown in FIG. 2, the pipe-cleaning device of this invention includes a center rod 200. The center rod 200 has a central hollow space that allows water or chemical solution to pass through. One end of the center rod 200 is connected to a handle 202. The handle 202 is used for grasping in manual operation. The other end of the center rod 200 at least includes an assembly of scrapers 204. The scraper assembly 204 is fixed on one end of the center rod 200. The scraper assembly comprises an upper scraper 206 and a lower scraper 208. Both the upper scraper 206 and the lower scraper 208 are designed to be "non-circular" and are fabricated into fan-shaped units. The lower scraper 208 further includes scraping knives 210 mounted on its blades.

Figure 3A:
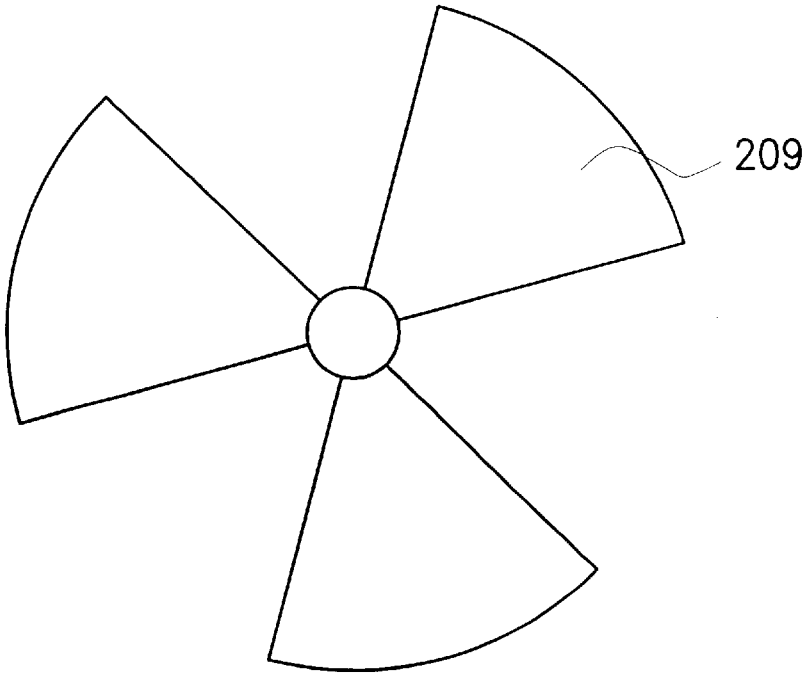
FIGS. 3A and 3B are top views showing the upper and lower scrapers of the pipe-cleaning device as shown in FIG. 2.
Figure 3B:
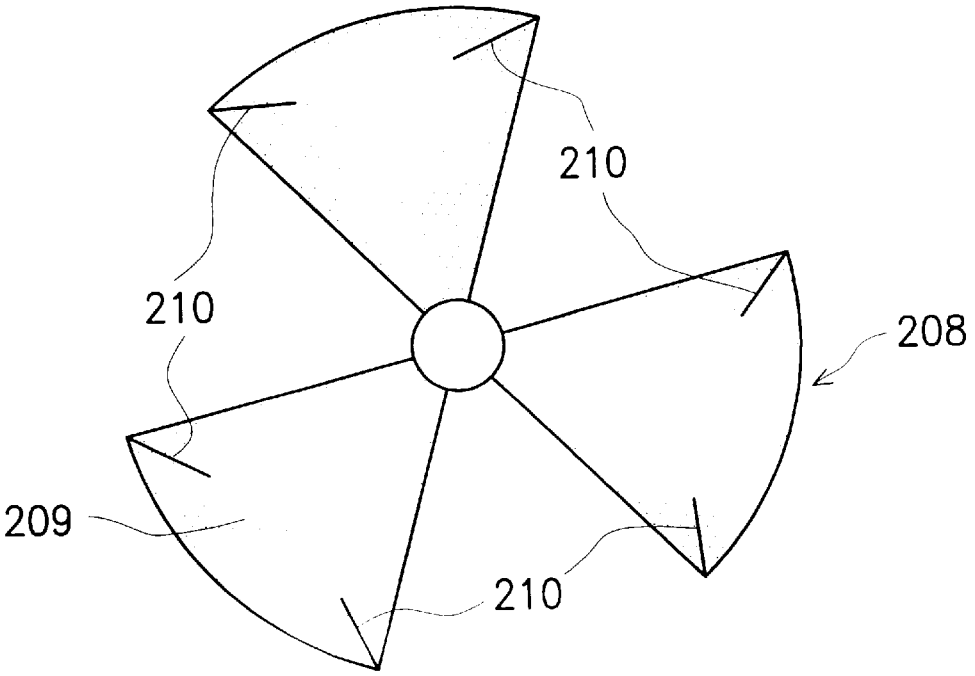

FIGS. 3A and 3B are top views showing the upper and lower scraper of the pipe-cleaning device. As shown in FIGS. 3A and 3B, the shape of the upper scraper 206 and the lower scraper 208 are complementary to each other. Each scraper can have three, four or more blades 209. In addition, each blade of the lower scraper can have an additional scraping knife 210 installed. The upper scraper 206 and the lower scraper 208 are both fixed to one end of the center rod 200. Therefore, when the upper scraper 206 and the lower scraper 208 are manually rotated, any blocking material on the sidewalls of the pipe can be easily scraped away. Furthermore, since the blades of the upper scraper 206 and the lower scraper 208 do not completely seal off the pipe, gas exhaustion is unaffected even when the pipe is undergoing a pipe-cleaning operation.

Figure 4:
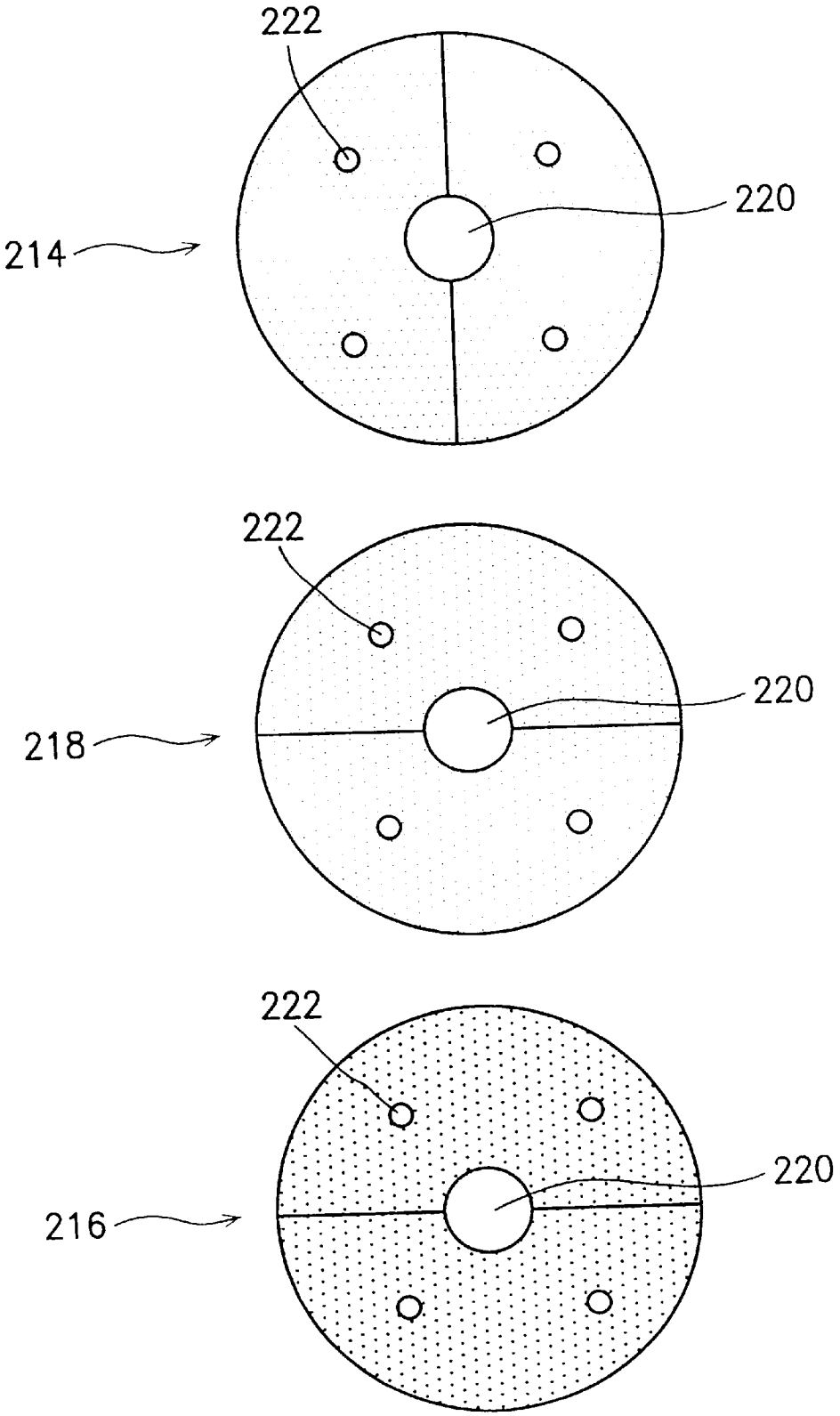
FIG. 4 is a top view showing the center rod sealing plates of the pipe-cleaning device as shown in FIG. 2.

As shown in FIG. 2, the pipe-cleaning device of this invention further includes a center rod sealing plate 212. The center rod sealing plate 212 is used to seal off the pipe opening. The sealing plate 212 has a three-plate structure that includes a first plate 214, a second plate 216 and a third plate 218. FIG. 4 is a top view showing the center rod sealing plates of the pipe-cleaning device. The first plate 214, the second plate 216 and the third plate 218 are all assembled from two semi-circular pieces. The two semi-circular pieces of the third plate 218 are positioned so that their seam is perpendicular to the seam of the semi-circular pieces of the first plate 214/second plate 216 assembly. Furthermore, the center of the assembled three-piece sealing plate 212 has a central hole 220 through which the center rod 200 can be inserted. Moreover, the first plate 214, the second plate 216 and the third plate 218 all have threaded holes 222 for tightening up the three plates using screws. The first plate 214 and the third plate 218 are made from a stainless steel material that can withstand the corrosive attack of the exhaust gases. The second plate 216 is usually made from rubber or plastic material. The rubber or plastic material can act as a sealant and can serve as a cushion at the junction between the first plate 214 and the second plate 216 so that the three plates can be more tightly bound. A three-piece design for the center rod sealing plate 212 makes maintenance much easier.

Also shown in FIG. 2 are a water inlet 224 next to the handle 202 on the center rod 200 and a water outlet 226 on the center rod 200 between the upper scraper 206 and the lower scraper 208. When the pipe is undergoing routine pipe-cleaning, water or a chemical solution can be pumped in through the inlet 224 into the center rod 200 and then ejected out through the outlet 226. Hence, a flushing action for cleaning the pipe is achieved in addition to the manual scraping operation.

Figure 5:
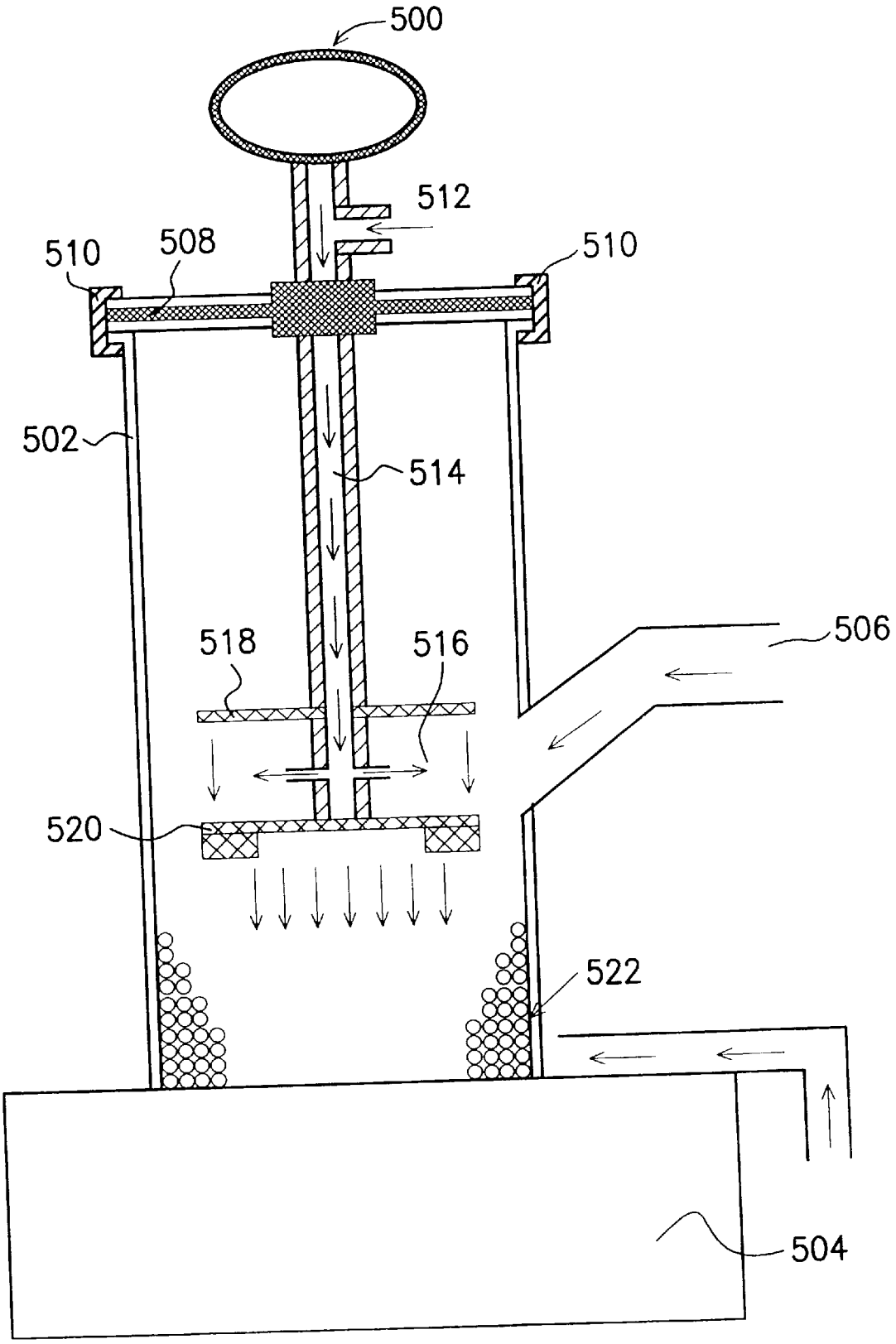
FIG. 5 shows the pipe-cleaning device as shown in FIG. 2 installed inside a pipe.

FIG. 5 shows the pipe-cleaning device as shown in FIG. 2 installed inside a pipe. The pipe-cleaning device 500 of this invention is installed at an opening of pipe 502. One end 522 of the pipe is connected to a wet scrubber water tank 504. A pipeline 506 is fixed to the side of the pipe 502 to allow exhaust gases to flow into the pipe 502. The center rod sealing plate 508 of the pipe-cleaning device 500 is placed on top of the pipe 502, wherein the sealing plate 508 and the opening end of the pipe 502 are tightened together using a C-clamp 510. In addition, the pipe-cleaning system also has a flushing system that allows water or a chemical solution to enter through a water inlet 512, pass through the center rod 514, and exit through a water outlet 516. When the above flushing system is combined with the manual rotation of the upper scraper 518 and the lower scraper 520 by turning the center rod 514, blocking material within the pipe can be scraped off and flushed away.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A pipe-cleaning device comprising:

a center rod having a hollow, tube-like central section;

a handle connected to one end of the center rod;

a scraper assembly fixed to the other end of the center rod, wherein the assembly includes an upper scraper and a lower scraper, both the upper and lower scrapers have a plurality of blades, the shape of blades of the upper scraper is complementary to the shape of blades of the lower scraper, and a plurality of scraping knives are fixed to the underside of the blades of the lower scraper; and a center rod sealing plate for sealing off a pipe opening and having a central hole for inserting the center rod, wherein the center rod further includes a water inlet next to the handle and a water outlet between the upper scraper and the lower scraper.

2. The device of claim 1, wherein the center rod sealing plate seals off the pipe opening by tightening up a clamp that clamps together the center rod sealing plate and the pipe opening.

3. The device of claim 1, wherein the clamp for tightening up the center rod sealing plate and the pipe opening includes a C-clamp.

4. A pipe-cleaning device comprising:

a center rod having a hollow, tube-like central section;

a handle connected to one end of the center rod;

a scraper assembly fixed to the other end of the center rod, wherein the assembly includes an upper scraper and a lower scraper; and a center rod sealing plate for sealing off a pipe opening, located between the handle and the scraper assembly, the center rod sealing plate including a central hole for inserting the center rod, within which hole the center rod is capable of moving freely, the center rod sealing plate having a three-plate structure that includes a first plate, a second plate and a third plate, the second plate being sandwiched between the first and the third plate so that the first and the third plate can be tightly assembled;

wherein the center rod further includes a water inlet next to the handle and a water outlet between the upper scraper and the lower scraper.

5. The device of claim 4, wherein the first plate, the second plate and the third plate of the three-plate structure are each assembled from two semi-circular plates, and the jointure of the two semi-circular plates of the third plate is positioned perpendicularly to the similarly aligned jointure of the semi-circular plates of the first and the second plates, and the center of the three-plate structure has a hole for inserting the center rod, wherein the three-plate structure further includes a plurality of threaded holes for tightening the first, second and third plates together using screws.

6. The device of claim 4, wherein the first plate and the second plate are made from stainless steel material.

7. The device of claim 4, wherein the second plate is made from rubber or plastic material.

8. The device of claim 4, wherein the center rod sealing plate seals off the pipe opening by tightening up a clamp that clamps together the sealing plate and the pipe opening.

9. The device of claim 4, wherein the clamp for tightening up the center rod sealing plate and the pipe opening includes a C-clamp.

* * * * *